US009172215B2

(12) United States Patent
Sakakura et al.

(10) Patent No.: US 9,172,215 B2
(45) Date of Patent: Oct. 27, 2015

(54) SPARK PLUG HAVING CENTER ELECTRODE TIP OF VARYING WIDTHS

(71) Applicant: NGK SPARK PLUG CO., LTD., Nagoya (JP)

(72) Inventors: Yasushi Sakakura, Ichinomiya (JP); Yukinobu Hasegawa, Nagoya (JP); Kei Takahashi, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 46 days.

(21) Appl. No.: 13/957,918

(22) Filed: Aug. 2, 2013

(65) Prior Publication Data

US 2014/0042893 A1 Feb. 13, 2014

(30) Foreign Application Priority Data

Aug. 8, 2012 (JP) ..... 2012-175737

(51) Int. Cl.
*H01T 13/20* (2006.01)
*H01T 13/39* (2006.01)
*H01T 13/32* (2006.01)

(52) U.S. Cl.
CPC ..... *H01T 13/32* (2013.01); *H01T 13/20* (2013.01); *H01T 13/39* (2013.01)

(58) Field of Classification Search
CPC ..... H01T 13/20; H01T 13/39
USPC ..... 313/138, 139, 141, 142
See application file for complete search history.

(56) References Cited

U.S. PATENT DOCUMENTS

| | | | | |
|---|---|---|---|---|
| 5,977,695 | A * | 11/1999 | Osamura et al. | 313/141 |
| 5,982,080 | A | 11/1999 | Shibata et al. | |
| 6,724,132 | B2 | 4/2004 | Kanao | |
| 2002/0021066 | A1 | 2/2002 | Kanao | |
| 2005/0093412 | A1 | 5/2005 | Lykowski et al. | |
| 2010/0259154 | A1 | 10/2010 | Nakamura et al. | |

FOREIGN PATENT DOCUMENTS

| | | | |
|---|---|---|---|
| CN | 101859984 | A | 10/2010 |
| JP | 02-204988 | A | 8/1990 |

(Continued)

OTHER PUBLICATIONS

Definition of periphery, retrieved from www.dictionary.com on Mar. 6, 2015.*

European Search Report mailed Oct. 25, 2013 for the corresponding European Patent Application No. 13179591.6.

(Continued)

*Primary Examiner* — Anh Mai
*Assistant Examiner* — Steven Horikoshi
(74) *Attorney, Agent, or Firm* — Leason Ellis LLP

(57) ABSTRACT

A spark plug includes a tip joined to a center electrode. The coefficient of linear thermal expansion of the center electrode is greater than that of the tip. The tip has a gap-forming portion having a maximum width of 1.2 mm or greater and forming a gap in cooperation with the ground electrode and a to-be-joined portion joined to the center electrode. At a position A which is shifted 0.1 mm from the forward end of the outer surface of the fusion portion toward the forward end side, the width of the to-be-joined portion measured on the cross section is smaller than the width of the gap-forming portion. The to-be-joined portion satisfies Dtw/Dw≤1.1, where Dtw represents the width of the to-be-joined portion at the position A, and Dw represents the width of the fusion portion at the forward end of the outer surface thereof.

14 Claims, 9 Drawing Sheets

(56) References Cited

FOREIGN PATENT DOCUMENTS

| | | | |
|---|---|---|---|
| JP | 09-330783 | A | 12/1997 |
| JP | 10-112374 | A | 4/1998 |
| JP | 2002-083662 | A | 3/2002 |

OTHER PUBLICATIONS

Office Action mailed Apr. 16, 2015 for the corresponding Chinese Application No. 201310344205.7.

* cited by examiner

SPARK PLUG HAVING CENTER ELECTRODE TIP OF VARYING WIDTHS

This application claims the benefit of Japanese Patent Application No. 2012-175737, filed Aug. 8, 2012, which is incorporated by reference in its entity herein.

FIELD OF THE INVENTION

The present invention relates to a spark plug used for an internal combustion engine, etc.

BACKGROUND OF THE INVENTION

A spark plug is attached to an internal combustion engine (engine), etc., and is used to ignite a fuel-air mixture within a combustion chamber or the like. In general, such a spark plug includes an insulator having an axial hole extending in an axial direction; a center electrode inserted into a forward end portion of the axial hole; a metallic shell provided around the insulator; and a ground electrode fixed to a forward end portion of the metallic shell. A high voltage is applied to a gap formed between a distal end portion of the ground electrode and a forward end portion of the center electrode, whereby spark discharge occurs, and the fuel-air mixture or the like is ignited.

Incidentally, when the size of the above-mentioned gap increases as a result of consumption (erosion) of the center electrode caused by spark discharge, etc., the voltage required to generate spark discharge (discharge voltage) also increases. If the discharge voltage becomes excessively high, generation of spark discharge becomes impossible (so-called misfire occurs).

A conceivable method of overcoming such a drawback is enhancing durability (erosion resistance) of the center electrode by joining to a forward end portion of the center electrode a tip which is formed of a metallic material which is excellent in erosion resistance (e.g., iridium or platinum) and which has a relatively large diameter. When such a tip is employed, the diameter of the forward end portion of the center electrode may be increased such that the diameter of the forward end portion of the center electrode becomes equal to the diameter of the tip. However, in the case where the coefficient of linear thermal expansion of the center electrode is larger than that of the tip (for example, in the case where the center electrode is formed of a nickel alloy or the like, and the tip is formed of an iridium alloy or the like), if the diameter of the forward end portion of the center electrode is increased, a very large thermal stress acts on the joint interface between the center electrode and the tip under a high temperature condition (e.g., when an internal combustion engine is operated). As a result, formation of a crack at the joint interface becomes more likely, and the tip may come off the center electrode.

A conceivable method of solving such a problem is rendering the diameter of the forward end portion of the center electrode smaller than that of the tip (see, for example, Japanese Patent Application Laid-Open (kokai) No. 2002-83662, etc.).

Problem to be Solved by the Invention

However, even when the technique described in Japanese Patent Application Laid-Open (kokai) No. 2002-83662 is employed, due to the influence of the tip having a relatively large diameter, the difference in thermal expansion between the tip and the center electrode increases, and consequently, a large thermal stress acts on the joint interface between the two members. As a result, formation of a crack at the joint interface becomes more likely, and the tip may come off the center electrode.

SUMMARY OF THE INVENTION

The present invention has been conceived in view of the above circumstances, and an object of the invention is to provide a spark plug which can remarkably increase the joint strength between a tip and a center electrode, while enhancing durability as a result of providing a relatively wide (large in diameter) portion of the tip forming a gap in cooperation with a ground electrode.

Means for Solving the Problems

Configurations suitable for solving the above problems will next be described in itemized form. If needed, actions and effects peculiar to the configurations will be described additionally.

Configuration 1. A spark plug of the present configuration comprises:

a tubular insulator having an axial hole extending in a direction of an axis;

a center electrode inserted into a forward end portion of the axial hole;

a tubular metallic shell provided around the insulator;

a ground electrode provided at a forward end portion of the metallic shell; and a tip which is made of metal, whose base end portion is joined to a forward end portion of the center electrode and whose forward end portion forms a gap in cooperation with a distal end portion of the ground electrode, wherein the tip is joined to the center electrode through a fusion portion which is formed over the entire circumference of the interface between a peripheral portion of a base end of the tip and a peripheral portion of a forward end of the center electrode and in which the tip and the center electrode are fused and mixed together, the center electrode has a coefficient of linear thermal expansion greater than that of the tip, the tip has a gap-forming portion which has a maximum width of 1.2 mm or greater as measured on a cross section including the axis and which forms the gap in cooperation with the ground electrode, and a to-be-joined portion which is located between the gap-forming portion and the fusion portion and adjacent to the fusion portion and which is joined to the center electrode;

at a position A which is shifted 0.1 mm from a forward end of an outer surface of the fusion portion toward the forward end side with respect to the direction of the axis, the width of the to-be-joined portion, measured on the cross section including the axis, is made smaller than the width of the gap-forming portion measured on the cross section; and the to-be-joined portion satisfies a relation $Dtw/Dw \leq 1.1$, where Dtw represents the width (mm) of the to-be-joined portion at the position A measured on the cross section, and Dw represents the width (mm) of the fusion portion at the forward end of the outer surface thereof measured on the cross section.

According to the above-described configuration 1, the tip has a gap-forming portion which has a maximum width of 1.2 mm or greater as measured on a cross section including the axis, and a gap is formed between the gap-forming portion and the ground electrode. Accordingly, the volume of erosion of the tip before causing misfire can be increased sufficiently, whereby durability can be enhanced.

Meanwhile, in the case where the width of the tip (the gap-forming portion) is increased and the coefficient of linear thermal expansion of the center electrode is made greater than that of the tip as in the above-described configuration 1, a crack may be generated at the joint interface between the tip and the center electrode, and the tip may come off.

According to the above-described configuration 1, the tip has a to-be-joined portion which is located between the gap-forming portion and the center electrode (fusion portion), whose width is smaller than that of the gap-forming portion at a position A which is shifted 0.1 mm from the forward end of the outer surface of the fusion portion toward the forward end side, and which satisfies a relation Dtw/Dw≤1.1, where Dtw represents the width (mm) of the to-be-joined portion at the position A, and Dw represents the width (mm) of the fusion portion at the forward end of the outer surface thereof (corresponding to the width of the forward end portion of the center electrode). Namely, a portion of the tip located in a range extending from the forward end of the fusion portion to a position shifted 0.1 mm from the forward end toward the forward end side; i.e., a portion which is a joint portion joined to the center electrode or the vicinity thereof and which produces a difference in thermal expansion between that portion and the center electrode upon thermal expansion thereof, has a width which is smaller than the width of the gap-forming portion and is approximately equal to or smaller than the width of the forward end portion of the center electrode. Accordingly, the difference in thermal expansion between the tip (the to-be-joined portion) and the center electrode can be reduced sufficiently, and the thermal stress acting on the joint interface between the tip and the center electrode can be reduced effectively. As a result, the joint strength between the tip and the center electrode can be increased remarkably, whereby coming off of the tip can be prevented more reliably.

Configuration 2. A spark plug of the present configuration is characterized in that, in the above-described configuration 1, a relation Dtw≤Dw is satisfied.

According to the above-described configuration 2, the relation Dtw≤Dw is satisfied. Therefore, the difference in thermal expansion between the tip (the to-be-joined portion) and the center electrode can be reduced further. Accordingly, the thermal stress acting on the joint interface between the tip and the center electrode can be reduced further, whereby the joint strength can be increased further.

Configuration 3. A spark plug of the present configuration is characterized in that, in the above-described configuration 1 or 2, the tip is joined to the center electrode in a state in which a protrusion provided on one of the tip and the center electrode is fitted into a recess provided on the other of the tip and the center electrode.

According to the above-described configuration 3, the tip is joined to the center electrode in a state in which a protrusion provided on one of the tip and the center electrode is fitted into a recess provided on the other of the tip and the center electrode. Accordingly, it is possible to prevent the tip from moving in the radial direction relative to the center electrode at the time of joining, to thereby reliably prevent deviation arising between the center axis of the center electrode and the center axis of the tip. Therefore, the fusion portion is formed such that the center electrode and the tip are fused and mixed together to a sufficient degree over the entire circumference. Thus, occurrence of a problem that the extent of fusion of the center electrode and that of the tip become imbalanced in a part of the fusion portion can be prevented more reliably. As a result, the joint strength can be increased further, whereby coming off of the tip can be prevented more reliably.

Configuration 4. A spark plug of the present configuration is characterized in that, in the above-described configuration 3, the recess is provided on the tip; and the maximum width of the recess measured on the cross section is ⅓ of the width Dtw or less.

According to the above-described configuration 4, the maximum width of the recess is ⅓ of the width Dtw or less. Accordingly, the wall thickness of the portion of the tip which surrounds the recess can be increased sufficiently, whereby a decrease in the strength of the tip attributable to provision of the recess can be suppressed effectively. As a result, it is possible to more reliably prevent breakage of the tip, which breakage would otherwise occur when vibration or the like acts on the tip. Accordingly, coming off of the tip can be prevented more reliably.

Configuration 5. A spark plug of the present configuration is characterized in that, in the above-described configuration 3 or 4, the recess is provided on the tip; and a bottom surface of the recess is located rearward of the rear end of a part of the to-be-joined portion whose width on the cross section is 1.1 Dw or greater.

According to the above-described configuration 5, the bottom surface of the recess is located rearward of the rear end of a part of the to-be-joined portion whose width on the cross section including the axis is 1.1 Dw or greater. Namely, the recess is not formed over the entirety of the axially extending range of a part of the to-be-joined portion, which part is made relatively narrow (part whose strength is likely to decrease), but is formed over only a portion of the axially extending range of the relatively narrow part of the to-be-joined portion. Accordingly, a decrease in the strength of the relatively narrow part of the to-be-joined portion can be suppressed effectively, whereby breakage of the tip which would otherwise occur upon application of vibration or the like to the tip can be prevented more reliably. As a result, coming off of the tip can be prevented with great effectiveness.

Configuration 6. A spark plug of the present configuration is characterized in that, in any of the above-described configurations 1 to 5, the tip is formed of iridium or a metallic material which contains iridium as a main component.

According to the above-described configuration 6, the tip is formed of iridium or a metallic material which contains iridium as a main component. Accordingly, particularly excellent durability can be realized by formation of the tip from such a material, combined with provision of the gap-forming portion having a relatively large width.

Ir or a metallic material which contains Ir as a main component is relatively fragile. Therefore, in the case where the tip is formed of Ir or a metallic material which contains Ir as a main component, the tip is likely to crack when a thermal stress acts on the joint interface between the tip and the center electrode. However, such a thermal stress can be reduced effectively through employment of the above-described configuration 1. Therefore, even when the tip is formed of Ir, etc. as in the above-described configuration 6, cracking of the tip can be prevented more reliably. In other words, the above-described configuration 1, etc. are very effective in the case where the tip is formed of Ir or a metallic material which contains Ir as a main component and there is a high possibility that the tip cracks due to thermal stress.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying Out the Invention

Figure 1:
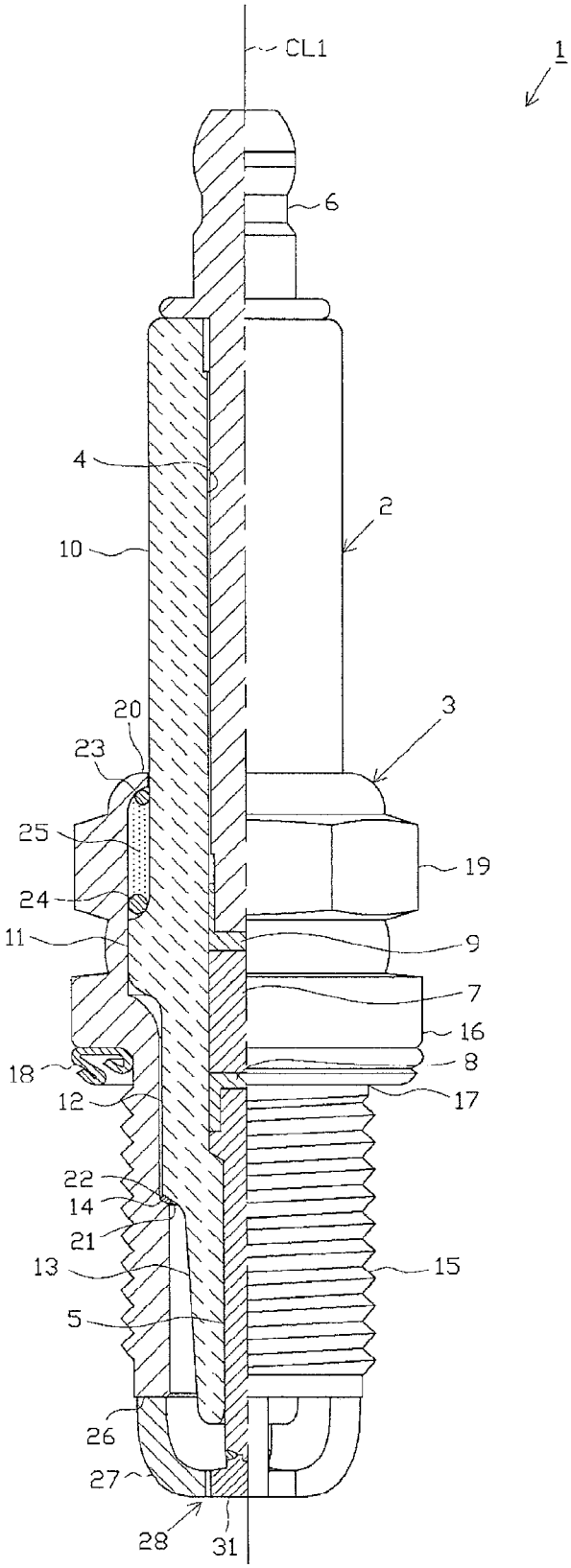
FIG. 1 is a partially cutaway front view showing the configuration of a spark plug.

One embodiment will next be described with reference to the drawings. FIG. 1 is a partially cutaway front view showing a spark plug 1. In the following description, the direction of an axis CL1 of the spark plug 1 in FIG. 1 is referred to as the vertical direction, and the lower side of the spark plug 1 in FIG. 1 is referred to as the forward end side of the spark plug 1, and the upper side as the rear end side of the spark plug 1.

The spark plug 1 includes a tubular ceramic insulator 2, which corresponds to the insulator recited in claims, a tubular metallic shell 3, which holds the ceramic insulator 2, etc.

The ceramic insulator 2 is formed from alumina or the like by firing, as well known in the art. The ceramic insulator 2 externally includes a rear trunk portion 10 formed on the rear end side; a large-diameter portion 11, which is located forward of the rear trunk portion 10 and projects radially outward; an intermediate trunk portion 12, which is located forward of the large-diameter portion 11 and is smaller in diameter than the large-diameter portion 11; and a leg portion 13, which is located forward of the intermediate trunk portion 12 and is smaller in diameter than the intermediate trunk portion 12. The large-diameter portion 11, the intermediate trunk portion 12, and most of the leg portion 13 of the ceramic insulator 2 are accommodated in the metallic shell 3. A tapered, stepped portion 14 is formed at a connection portion between the leg portion 13 and the intermediate trunk portion 12, and the ceramic insulator 2 is seated on the metallic shell 3 via the stepped portion 14.

The ceramic insulator 2 has an axial hole 4 extending therethrough along the axis CL1, and a center electrode 5 is fixedly inserted into a forward end portion of the axial hole 4. The center electrode 5 is formed of a metallic material which contains nickel (Ni) as a main component. The center electrode 5 assumes a rodlike (circular columnar) shape as a whole. The center electrode 5 has a forward end portion which projects from the forward end of the ceramic insulator 2. A base end portion of a tip 31 formed of a predetermined metallic material (in the present embodiment, iridium (Ir) or a metallic material which contains Ir as a main component) is joined to the forward end portion of the center electrode 5. In the preset embodiment, the coefficient of linear thermal expansion of the metallic material which constitutes the center electrode 5 is greater than that of the metallic material which constitutes the tip 31.

A terminal electrode 6 is fixedly inserted into a rear end portion of the axial hole 4 in such a manner as to project from the rear end of the ceramic insulator 2.

A circular columnar resistor 7 is disposed within the axial hole 4 between the center electrode 5 and the terminal electrode 6. Opposite end portions of the resistor 7 are electrically connected to the center electrode 5 and the terminal electrode 6 via electrically conductive glass seal layers 8 and 9, respectively.

The metallic shell 3 is formed into a tubular shape from a metallic material such as low-carbon steel and has a threaded portion (externally threaded portion) 15 on its outer circumferential surface, and the threaded portion 15 is used to mount the spark plug 1 to a combustion apparatus (e.g., an internal combustion engine or a fuel cell reformer). The metallic shell 3 has a seat portion 16 formed on its outer circumferential surface and located rearward of the threaded portion 15. A ring-like gasket 18 is fitted to a screw neck 17 located at the rear end of the threaded portion 15. The metallic shell 3 has a tool engagement portion 19 provided near its rear end. The tool engagement portion 19 has a hexagonal cross section and allows a tool such as a wrench to be engaged therewith when the metallic shell 3 is to be mounted to the combustion apparatus. The metallic shell 3 also has a crimp portion 20 bent radially inward.

The metallic shell 3 has a tapered, stepped portion 21 provided on its inner circumferential surface and adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the above-mentioned crimp portion 20 is formed, whereby the ceramic insulator 2 is fixed to the metallic shell 3. An annular sheet packing 22 intervenes between the stepped portions 14 and 21. This retains gastightness of a combustion chamber and prevents leakage of fuel gas to the exterior of the spark plug 1 through a clearance between the inner circumferential surface of the metallic shell 3 and the leg portion 13 of the ceramic insulator 2, the clearance being exposed to the combustion chamber.

In order to realize more complete gastightness by crimping, annular ring members 23 and 24 intervene between the metallic shell 3 and the ceramic insulator 2 in a region near the rear end of the metallic shell 3, and a space between the ring members 23 and 24 is filled with powder of talc 25. That is, the metallic shell 3 holds the ceramic insulator 2 via the sheet packing 22, the ring members 23 and 24, and the talc 25.

Figure 2:
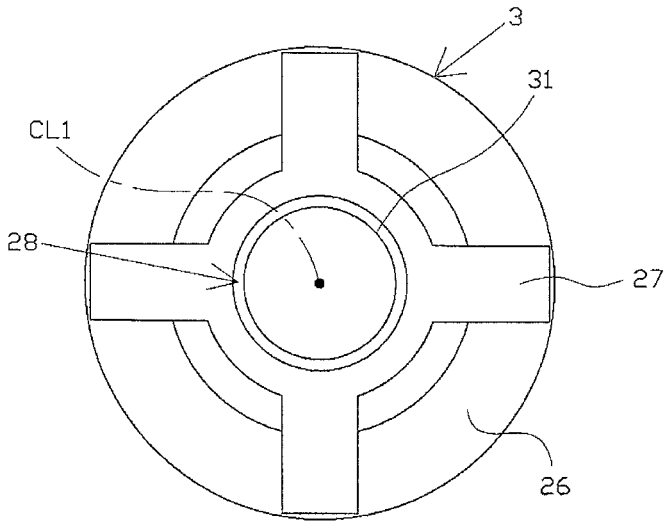
FIG. 2 is a bottom view showing the configuration of a ground electrode.

A ground electrode 27 is disposed at a forward end portion 26 of the metallic shell 3. The ground electrode 27 is formed of a predetermined metallic material (e.g., a metallic material which contains Ni as a main component), and has an annular portion which is disposed around the tip 31 and whose center coincides with the axis CL1 as shown in FIG. 2. The distal end surface (the entire inner circumferential surface of the annular portion) of the ground electrode 27 faces the outer circumferential surface of a gap-forming portion 31X of the tip 31, which will be described later. A spark discharge gap 28, which corresponds to the gap recited in claims, is formed between the outer circumferential surface of the gap-forming portion 31X and the distal end surface of the ground electrode 27. Thus, at the spark discharge gap 28, spark discharge occurs in directions generally perpendicular to the axis CL1.

Next, the configurations of the center electrode 5 and the tip 31 joined thereto, which are the characteristic portions of the present invention, will be descried.

Figure 3:
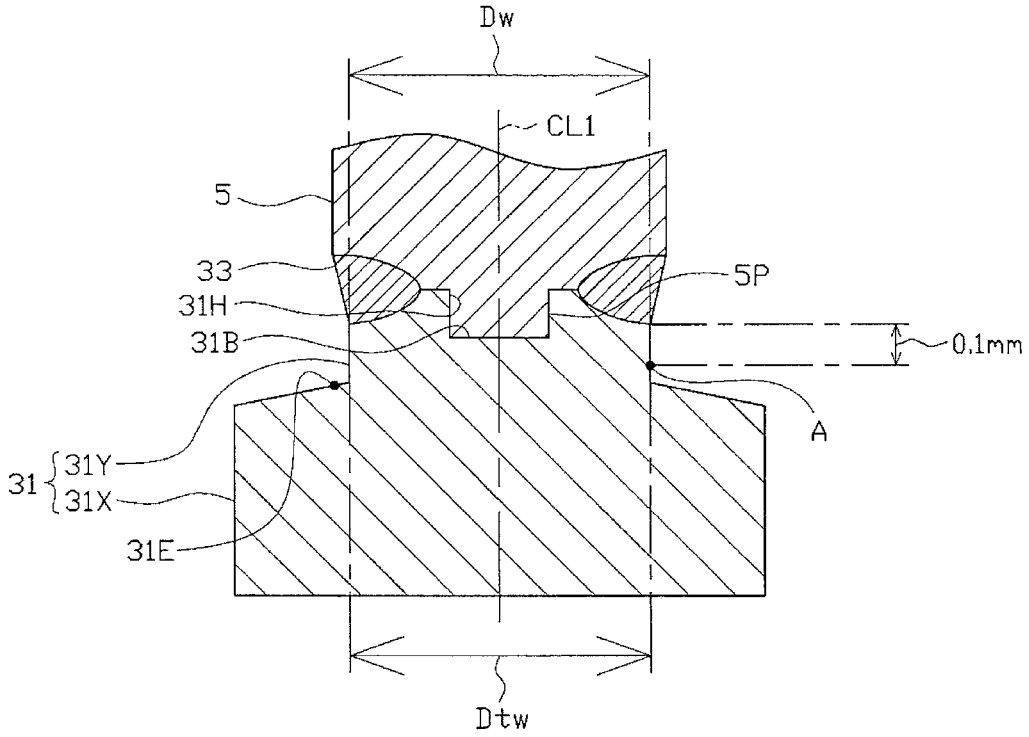
FIG. 3 is an enlarged partial sectional view showing the configurations of a center electrode and a tip.

As shown in FIG. 3, the tip 31 is joined to the center electrode 5 through an annular fusion portion 33, which is formed as a result of fusion and mixture of the tip 31 and the center electrode 5. The fusion portion 33 is formed by disposing the tip 31 on the forward end surface of the center electrode 5 and applying a laser beam or electron beam to the contact interface between the center electrode 5 and the tip 31 over the entire circumference thereof. In the present embodiment, the fusion portion 33 is formed over the entire circumference of the interface between a peripheral portion of the base end of the tip 31 and a peripheral portion of the forward end of the center electrode 5. Further, in the present embodiment, the tip 31 is disposed coaxial with the center electrode 5. Notably, the expression "the tip 31 is disposed coaxial with the center electrode 5" encompasses not only the case where the center axis of the tip 31 perfectly coincides with the center axis of the center electrode 5 but also the case where the center axis of the tip 31 slightly deviates from the center axis of the center electrode 5.

In the present embodiment, the tip 31 has the gap-forming portion 31X. The gap-forming portion 31X is located at the forwardmost end of the tip 31 and has a circular columnar shape. The gap-forming portion 31X has a diameter greater than that of the forward end portion of the center electrode 5. The diameter of the gap-forming portion 31X (its width measured on a cross section thereof including the axis CL1) is set to 1.2 mm or greater. Thus, it is possible to sufficiently increase the volume of erosion of the tip 31 caused by spark discharge, which volume represents the cumulative amount of erosion before occurrence of misfire, whereby satisfactory durability can be secured. In particular, in the present embodiment, since the annular spark discharge gap 28 is formed between the entire region of the outer circumferential surface of the gap-forming portion 31X and the distal end surface of the ground electrode 27, spark discharge can be produced over the entire region of the outer circumferential surface of the gap-forming portion 31X, whereby the tip 31 can be used more effectively. As a result, the volume of erosion of the tip 31 before causing misfire can be increased remarkably, whereby excellent durability can be realized.

As described above, the above-mentioned erosion volume can be increased by providing the tip 31 with the gap-forming portion 31X having a relatively large diameter. However, in the case where a portion of the tip 31 which has a relatively large diameter (a portion corresponding to the gap-forming portion 31X) is directly joined to the center electrode 5, a considerably large difference in thermal expansion is produced between the center electrode 5 and the tip 31 when the internal combustion engine or the like is operated. As a result, a crack may be produced at the joint interface between the center electrode 5 and the tip 31, and the tip 31 may come off the center electrode 5.

In view of this, in the present embodiment, the tip 31 has a to-be-joined portion 31Y. At a position A which is shifted 0.1 mm from the forward end of the outer surface of the fusion portion 33 toward the forward end side with respect to the direction of the axis CL1, the width (length in the direction perpendicular to the axis CL1) of the to-be-joined portion 31Y, measured on a cross section thereof including the axis CL1, is made smaller than the width of the gap-forming portion 31X measured on that cross section (in the present embodiment, the diameter of the to-be-joined portion 31Y is made smaller than that of the gap-forming portion 31X). The to-be-joined portion 31Y is located adjacent to the fusion portion 33 and is joined to the center electrode 5. Also, the to-be-joined portion 31Y satisfies a relation $Dtw/Dw \leq 1.1$ (more preferably, a relation $Dtw \leq Dw$), where Dtw represents the width (mm) of the to-be-joined portion 31Y at the above-mentioned position A measured on the cross section including the axis CL1, and Dw represents the width (mm) of the fusion portion 33 at the forward end of the outer surface thereof measured on the cross section. Namely, the width Dtw of the to-be-joined portion 31Y measured in the vicinity of a portion thereof joined to the center electrode 5 is made 1.1 times or less (more preferably, equal to or less than) the width Dw (corresponding to the width of a portion of the center electrode 5 to which the to-be-joined portion 31Y is joined). By virtue of this, the difference in thermal expansion between the center electrode 5 and the tip 31 can be reduced, whereby generation of cracks can be suppressed. In particular, in the present embodiment, at least in a region extending from the forward end of the outer surface of the fusion portion 33 to a position shifted 0.1 mm from the forward end toward the forward end side with respect to the direction of the axis CL1, the width Dtw of the to-be-joined portion 31Y measured on the above-mentioned cross section is made 1.1 times or less the width Dw of the fusion portion 33 at the forward end of the outer surface thereof. As a result, the above-described effect of reducing the difference in thermal expansion can be attained more reliably. Notably, in the present embodiment, the width Dw is set to a predetermined value (e.g., 1.0 mm) or less.

Figure 4:
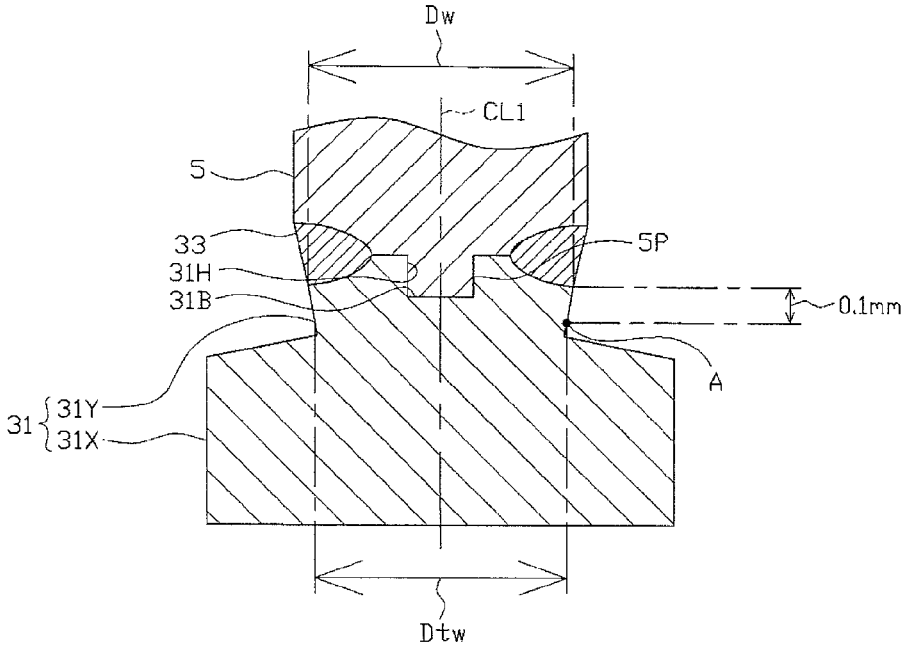
FIG. 4 is an enlarged partial sectional view showing another example of the tip.
Figure 5:
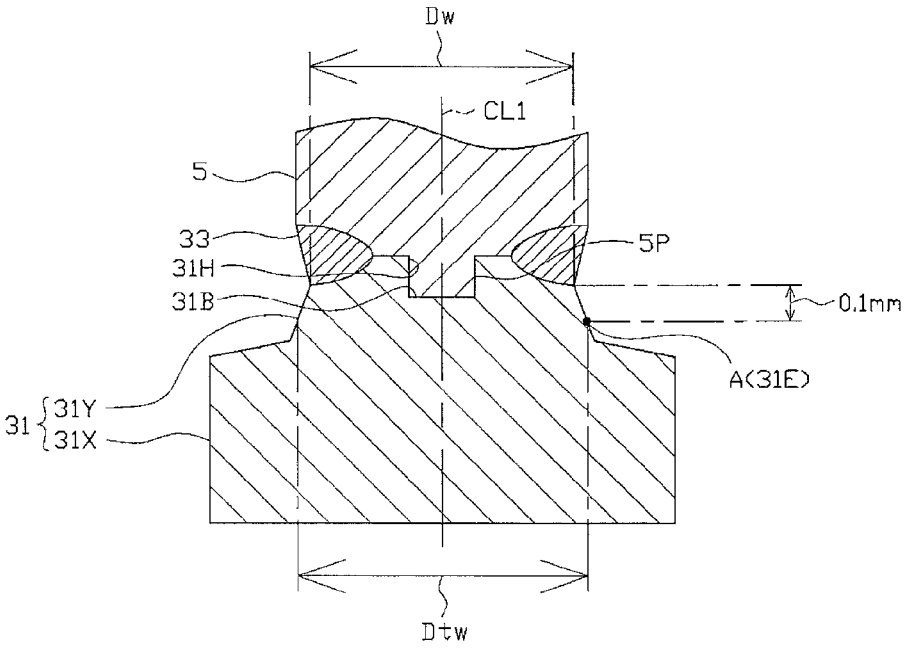
FIG. 5 is an enlarged partial sectional view showing another example of the tip.

In the present embodiment, the base end portion of the to-be-joined portion 31Y has the shape of a circular column which has a fixed diameter along the direction of the axis CL1. However, the shape of the to-be-joined portion 31Y is not limited thereto. For example, as shown in FIG. 4, the base end portion of the to-be-joined portion 31Y may be formed such that its diameter decreases gradually toward the forward end side with respect to the direction of the axis CL1. Alternatively, as shown in FIG. 5, the base end portion of the to-be-joined portion 31Y may be formed such that its diameter increases gradually toward the forward end side with respect to the direction of the axis CL1. However, even in such a case, the widths Dtw and Dw are determined such that the relation $Dtw/Dw \leq 1.1$ is satisfied.

Additionally, in the present embodiment, on the cross section including the axis CL1, the forward end of the outer surface of the fusion portion 33 located on one side of the axis CL1 and the forward end of the outer surface of the fusion portion 33 located on the other side of the axis CL1 are located on the same position along the direction of the axis CL1. However, the forward end of the outer surface of the fusion portion 33 located on one side of the axis CL1 and the forward end of the outer surface of the fusion portion 33 located on the other side of the axis CL1 may be deviated from each other in the direction of the axis CL1. In this case, the "width Dw of the fusion portion 33 at the forward end of the outer surface" refers to the width of the fusion portion 33 at the forward end of a region within which the fusion portion 33 is present on the two sides (opposite sides) of the axis CL1 on the cross section including the axis CL1.

Referring back to FIG. 3, in the present embodiment, a circular columnar protrusion 5P having a fixed diameter along the axis CL1 is provided at the center of the forward end surface of the center electrode 5, and a recess 31H having a fixed diameter along the axis CL1 is provided at the center of the base end surface (a surface located on the side toward the center electrode 5) of the tip 31 (the base end surface of the to-be-joined portion 31Y). The tip 31 is joined to the center electrode 5 in a state in which the protrusion 5P is fitted into the recess 31H.

Also, on the cross section including the axis CL1, the maximum width of the recess 31H along the direction perpendicular to the axis CL1 is rendered ⅓ of the width Dtw or less. Namely, the tip 31 is configured such that a part of the to-be-joined portion 31Y located around the recess 31H has a sufficiently large wall thickness.

In addition, the tip 31 is configured such that the bottom surface 31B of the recess 31H is located rearward of the rear end 31E of a part of the to-be-joined portion 31Y, the width of which on the cross section including the axis CL1 is 1.1 Dw or greater.

Figure 6:
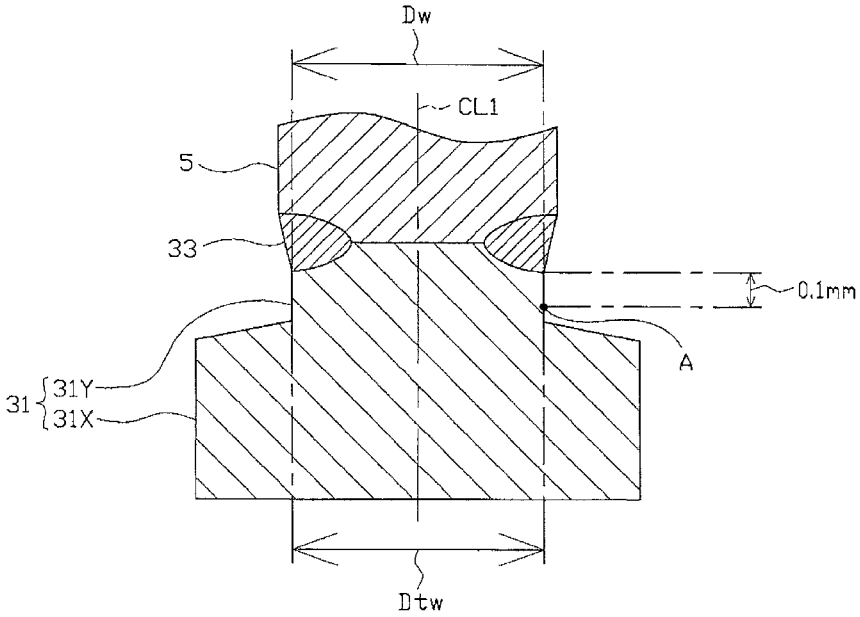
FIG. 6 is an enlarged partial sectional view showing another example of the center electrode and another example of the tip.

Notably, the protrusion 5P and the recess 31H need not be provided, and as shown in FIG. 6, the protrusion and the recess may be omitted.

Figure 7:
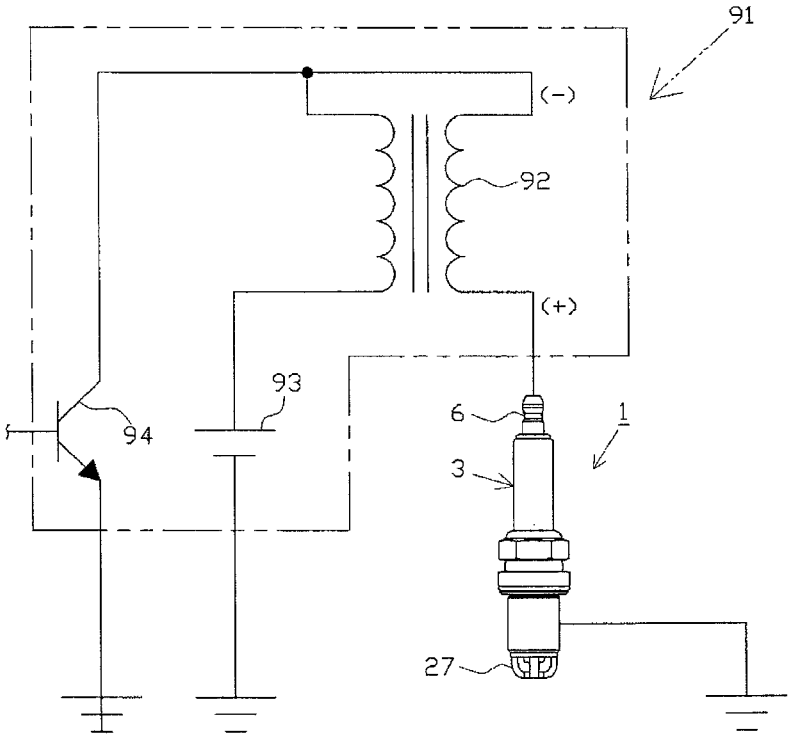
FIG. 7 is a schematic diagram showing the configuration of a voltage application section, etc.

In the present embodiment, as shown in FIG. 7, spark discharge my be generated by a voltage application section 91 which includes an ignition coil 92, a power supply 93, and an igniter 94. In such a case, a high voltage of positive polarity is applied to the terminal electrode 6 (eventually to the center electrode 5) (in other words, the ground electrode 27 has the negative polarity). At the time of spark discharge, the positive polarity side is eroded less than the negative polarity side. Therefore, through employment of the above-described configuration, of the distal end surface of the ground electrode 27 and the outer circumferential surface of the gap-forming portion 31X which form the spark discharge gap 28, the outer circumferential surface of the gap-forming portion 31X which has a smaller area can be reduced in erosion speed. As a result, a sharp increase in the size of the spark discharge gap 28 can be prevented more reliably, whereby more excellent durability can be realized.

As having been described in detail, according to the present embodiment, the tip 31 has the gap-forming portion 31X which has a maximum width of 1.2 mm or more measured on the cross section including the axis CL1, and the spark discharge gap 28 is formed between the gap-forming portion 31X and the ground electrode 27. Accordingly, the volume of erosion of the tip 31 before causing misfire can be increased sufficiently, whereby the durability of the tip 31 can be enhanced.

In the present embodiment, the tip 31 includes the to-be-joined portion 31Y the width of which is smaller than the width of the gap-forming portion 31X at the above-mentioned position A and which satisfies the relation $Dtw/Dw \leq 1.1$, where Dtw represents the width (mm) of the to-be-joined portion 31Y at the position A, and Dw represents the width (mm) of the fusion portion 33 at the forward end of the outer surface thereof (corresponding to the width of the forward end portion of the center electrode 5). Namely, a portion of the tip 31 located in a range extending from the forward end of the fusion portion 33 to a position shifted 0.1 mm from the forward end toward the forward end side; i.e., a portion which is a joint portion joined to the center electrode 5 or the vicinity thereof and which produces a difference in thermal expansion between that portion and the center electrode 5 upon thermal expansion thereof, has a width which is smaller than the width of the gap-forming portion 31X and is approximately equal to or smaller than the width of the forward end portion of the center electrode 5. Accordingly, the difference in thermal expansion between the tip 31 (the to-be-joined portion 31Y) and the center electrode 5 can be reduced sufficiently, and the thermal stress acting on the joint interface between the tip 31 and the center electrode 5 can be reduced effectively. As a result, the joint strength between the tip 31 and the center electrode 5 can be increased remarkably, whereby coming off of the tip 31 can be prevented more reliably.

Moreover, the tip 31 is joined to the center electrode 5 in a state in which the protrusion 5P of the center electrode 5 is fitted into the recess 31H of the tip 31. Accordingly, it is possible to more reliably prevent the center axis of the center electrode 5 and the center axis of the tip 31 from deviating from each other at the time of joining. Therefore, the fusion portion 33 is formed such that the center electrode 5 and the tip 31 are fused and mixed to a sufficient degree over the entire circumference thereof, and occurrence of a problem that the extent of fusion of the center electrode 5 and that of the tip 31 become imbalanced in a part of the fusion portion 33 can be prevented more reliably. As a result, the joint strength can be increased further, whereby coming off of the tip 31 can be prevented further more reliably.

In addition, the maximum width of the recess 31H measured on the cross section including the axis CL1 is made ⅓ of the width Dtw or less. Accordingly, the wall thickness of the portion of the tip 31 which surrounds the recess 31H can be increased sufficiently, whereby a decrease in the strength of the tip 31 attributable to provision of the recess 31H can be suppressed effectively. As a result, it is possible to more reliably prevent breakage of the tip 31, which breakage would otherwise occur when vibration or the like acts on the tip 31. Accordingly, coming off of the tip 31 can be prevented more reliably.

Furthermore, the bottom surface 31B of the recess 31H is located rearward of the rear end 31E of a part of the to-be-joined portion 31Y, the width of which on the cross section including the axis CL1 is 1.1 Dw or greater. Accordingly, a decrease in the strength of the relatively narrow part of the to-be-joined portion 31Y can be suppressed effectively. Thus, it is possible to more reliably prevent breakage of the tip 31, which breakage would otherwise occur when vibration or the like acts on the tip 31. As a result, coming off of the tip 31 can be prevented more reliably.

Next, in order to confirm the action and effects provided by the above-described embodiment, spark plug samples 1 to 3 (comparative examples) and spark plug samples 4 and 5 (examples) were manufactured, and a thermal bench test was carried out for each sample. The outline of the thermal bench test is as follows. Namely, for each sample, an operation of heating the tip to 900° C. in the atmosphere by using a predetermined gas burner and then cooling the tip to 200° C. was repeated a predetermined number of times. After that, the sample was checked so as to determine whether or not a crack was generated at the joint interface between the tip and the center electrode. For the sample 5, another thermal bench test was performed with the heating temperature of the tip changed from 900° C. to 1000° C. (namely, under a severer condition), and the sample was checked so as to determine whether or not a crack was generated. Table 1 shows the results of this test.

Figure 8:
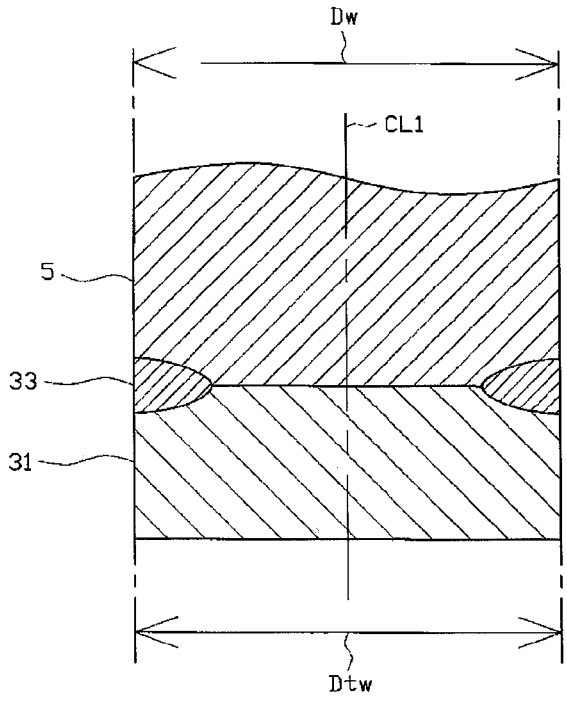
FIG. 8 (Prior art)
FIG. 8 is an enlarged partial sectional view showing the configuration of sample 1.

As shown in FIG. 8, in the case of sample 1 (comparative example), a tip having no to-be-joined portion was used, and a portion of the tip, the portion having a relatively large diameter and corresponding to the gap-forming portion, was joined to a center electrode having the same diameter as that portion. Each of the tip width, the width DtW, and the width Dw, measured on a cross section including the axis, was set to 3.0 mm.

Figure 9:
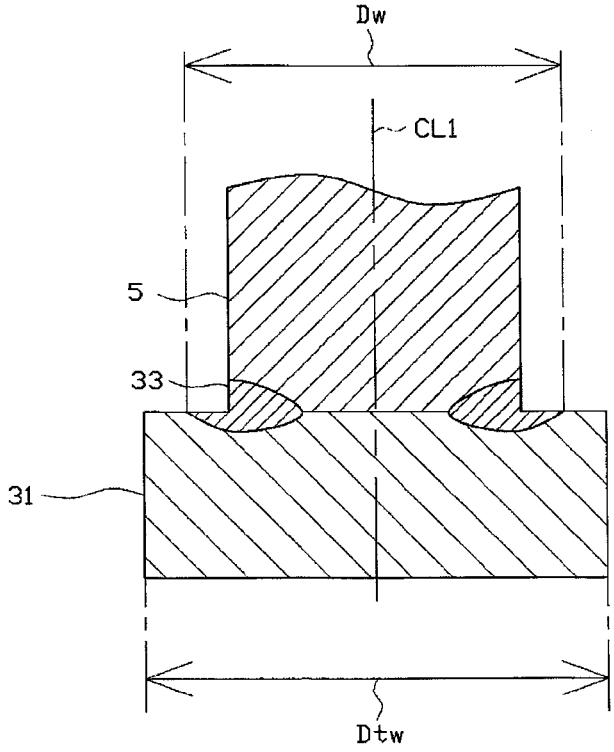
FIG. 9 (Prior art)
FIG. 9 is an enlarged partial sectional view showing the configuration of sample 2.

As shown in FIG. 9, in the case of sample 2 (comparative example), a tip having no to-be-joined portion was used, and a portion of the tip, the portion having a relatively large diameter and corresponding to the gap-forming portion, was joined to a center electrode having a diameter smaller than the diameter of that portion. The tip width, the width DtW, and the width Dw, measured on a cross section including the axis, were set to 3.0 mm, 3.0 mm, and 2.5 mm, respectively.

Figure 10:
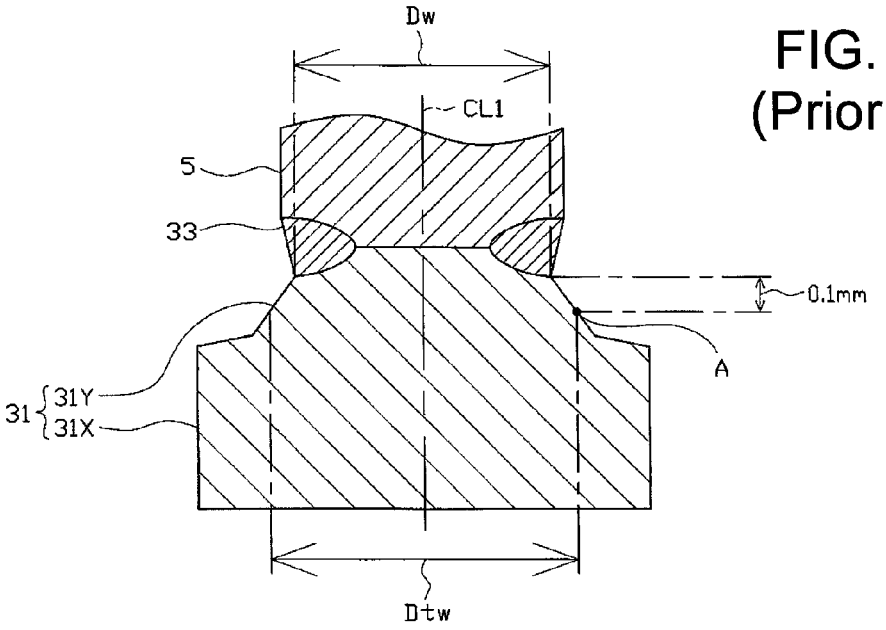
FIG. 10 (Prior art)
FIG. 10 is an enlarged partial sectional view showing the configuration of sample 3.

As shown in FIG. 10, in the case of sample 3 (comparative example), a tip having a gap-forming portion and a to-be-joined portion was used, the to-be-joined portion was joined to a center electrode, and a relation Dtw/Dw=1.2 was satisfied.

Figure 11:
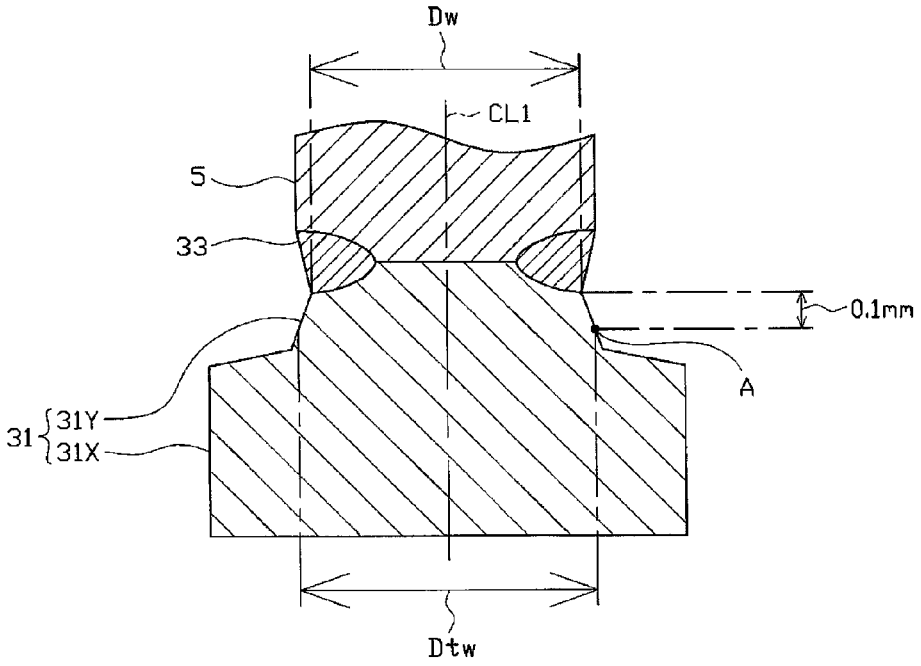
FIG. 11 is an enlarged partial sectional view showing the configuration of sample 4.

As shown in FIG. 11, in the case of sample 4 (example), a tip having a gap-forming portion and a to-be-joined portion was used, the to-be-joined portion was joined to a center electrode, and a relation Dtw/Dw=1.1 was satisfied.

As shown in FIG. 6, in the case of sample 5 (example), a tip having a gap-forming portion and a to-be-joined portion was used, the to-be-joined portion was joined to a center electrode, and a relation Dtw=Dw was satisfied. The width of the gap-forming portion, the width DtW, and the width Dw, measured on a cross section including the axis, were set to 3.0 mm, 2.0 mm, and 2.0 mm, respectively.

TABLE 1

| Sample No. | Thermal test of 900° C. to 200° C. | Thermal test of 1000° C. to 200° C. |
|---|---|---|
| 1 | Crack generated | — |
| 2 | Crack generated | — |
| 3 | Crack generated | — |
| 4 | No crack | Crack generated |
| 5 | No crack | No crack |

As shown in Table 1, it was found that, in the case of the samples in which the tip did not have the to-be-joined portion and the gap-forming portion having a relatively large diameter was joined to the center electrode (samples 1 and 2) and in the case of the sample satisfying the relation Dtw/Dw>1.1 (sample 3), a crack was generated at the joint interface between the tip and the center electrode, and joint strength was low. Conceivably, generation of a crack occurred because a large difference in thermal expansion was produced between the tip and the center electrode, and a large load acted on the joint interface.

In contrast, it was found that, in the case of the samples in which the to-be-joined portion was joined to the center electrode and the relation Dtw/Dw≤1.1 was satisfied (samples 4 and 5), no crack was generated at the joint interface between the tip and the center electrode, and joint strength was excellent. Conceivably, generation of a crack was prevented because the amount of thermal expansion of a part of the to-be-joined portion joined to the center electrode and the vicinity of that part (namely, a part whose thermal expansion results in production of a difference in thermal expansion between that part and the center electrode) was able to be decreased sufficiently, whereby the difference in thermal expansion between the tip and the center electrode was able to be decreased effectively.

In particular, for the case of the sample satisfying the relation Dtw=Dw (sample 5), it was confirmed that no crack was generated even when the temperature of the tip was increased to 1000° C. during the test (i.e., the test was performed under a very severe condition), and the sample was extremely excellent in terms of joint strength.

The results of the above-described test reveal that, in order to increase the joint strength between the tip and the center electrode in the case where the maximum diameter (maximum width) of the tip is made relatively large in order to enhance durability, it is preferred that the to-be-joined portion of the tip, which portion is relatively small in diameter (width), be joined to the center electrode, and the relation Dtw/Dw≤1.1 be satisfied.

Also, in order to further increase the joint strength, it is preferred to satisfy the relation Dtw=Dw.

Next, 100 samples of a spark plug having no protrusion on the center electrode and 100 samples of a spark plug having a protrusion on the center electrode were manufactured. Specifically, each sample of the spark plug having no protrusion on the center electrode was manufactured as follows. The forward end surface of the center electrode and the base end surface (a surface to be joined to the center electrode) of the to-be-joined portion were made flat; the base end surface of the to-be-joined portion was disposed on the forward end surface of the center electrode in a state in which the center axis of the center electrode and the center axis of the tip were aligned with each other; and the tip and the center electrode were joined together by laser welding. Each sample of the spark plug having a protrusion on the center electrode was manufactured as follows. A protrusion was provided on the forward end surface of the center electrode; a recess was provided on the base end surface of the to-be-joined portion; and the tip and the center electrode were joined together by laser welding in a state in which the protrusion was fitted into the recess and the center electrode and the center axis of the center electrode and the center axis of the tip were aligned with each other. After joining the tip and the center electrode together, each sample were measured so as to determine the deviation of the center axis of the tip from the center axis of the center electrode in the direction perpendicular to the axis. Next, a plurality of deviation ranges were defined by dividing the entire deviation range such that each deviation range had a width of 0.02 mm, and the number of samples which fell in each deviation range was obtained for the samples having no protrusion and the samples each having a protrusion. Table 2 shows the results of this test.

TABLE 2

| | Number of sample | |
|---|---|---|
| Deviation of axis | No protrusion | Protrusion provided |
| 0.02 mm or less | 5 | 80 |
| Greater than 0.02 mm but not greater than 0.04 mm | 10 | 15 |
| Greater than 0.04 mm but not greater than 0.06 mm | 20 | 5 |
| Greater than 0.06 mm but not greater than 0.08 mm | 25 | 0 |
| Greater than 0.08 mm but not greater than 0.10 mm | 20 | 0 |

TABLE 2-continued

| Deviation of axis | Number of sample: No protrusion | Number of sample: Protrusion provided |
|---|---|---|
| Greater than 0.10 mm but not greater than 0.12 mm | 15 | 0 |
| Greater than 0.12 mm but not greater than 0.14 mm | 5 | 0 |

As shown in Table 2, it was found that, in the case of the samples (with protrusions) in which the tip and the center electrode were joined together with the protrusion fitted into the recess, the deviation of axis can be decreased remarkably, and the center electrode and the tip can be accurately aligned with each other. Conceivably, this accurate alignment becomes possible because movement of the tip relative to the center electrode in the radial direction is suppressed at the time of welding. Notably, similar results were obtained for the case where a protrusion was provided on the tip, and a recess was provided on the center electrode.

The results of the above-described test reveal that, from the view point of increasing the alignment accuracy of the center electrode and the tip, it is preferred that the tip be joined to the center electrode in a state in which the protrusion provided on one of the tip and the center electrode is fitted into the recess provided on the other of the tip and the center electrode. Notably, by accurately aligning the center electrode and the tip with each other, at the time of joining, the center electrode and the tip can be fused and mixed sufficiently over the entire region in the circumferential direction, whereby joint strength can be increased further.

Next, spark plug samples 11 to 13 were manufactured by changing the width of the recess (protrusion) and the length of the recess (protrusion) along the axis, and an impact resistance test prescribed in JIS B8031 was performed for each sample. Specifically, impacts were applied to each sample for 10 minutes at a rate of 400 impacts per min. After the test, each sample was checked so as to determine whether or not breakage of the tip occurred. Table 3 shows the results of this test.

Figure 12:
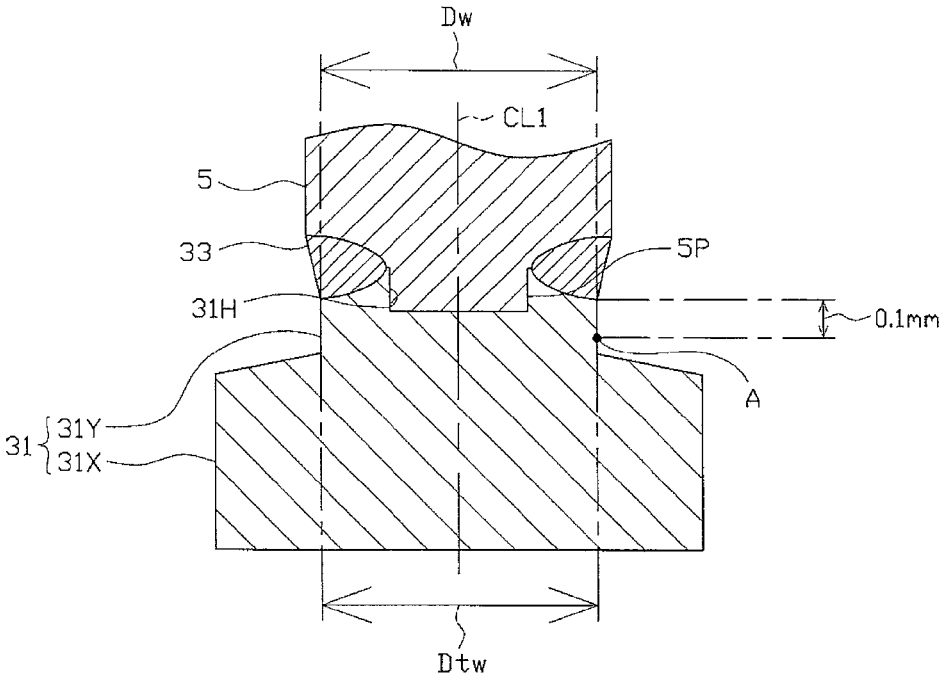
FIG. 12 is an enlarged partial sectional view showing the configuration of sample 11.
Figure 13:
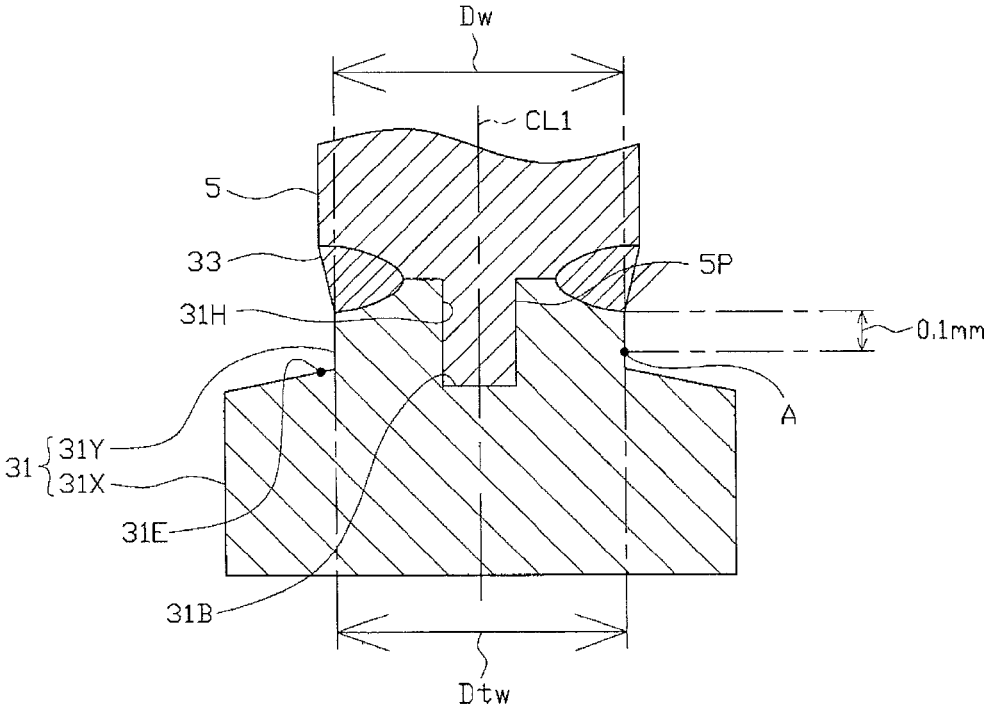
FIG. 13 is an enlarged partial sectional view showing the configuration of sample 12.

Notably, sample 11 was manufactured such that, as shown in FIG. 12, a recess was provided on the tip, a protrusion was provided on the center electrode, and the maximum width of the recess measured on a cross section including the axis was ½ of the width Dtw. Sample 12 was manufactured such that, as shown in FIG. 13, a recess was provided on the tip, a protrusion was provided on the center electrode, and the bottom surface of the recess was located forward of the rear end of the part of the to-be-joined portion whose width on the cross section was 1.1 Dw or greater. Sample 13 was manufactured such that, as shown in FIG. 3, a recess was provided on the tip, a protrusion was provided on the center electrode, the maximum width of the recess measured on a cross section including the axis was ⅓ of the width Dw, and the bottom surface of the recess was located rearward of the rear end of the part of the to-be-joined portion whose width on the cross section was 1.1 Dw or greater.

Notably, all the samples were identical in terms of the shape of the outer surface of the tip (for example, the width of the gap-forming portion, etc.).

TABLE 3

| | Evaluation on impact resistance |
|---|---|
| Sample 11 | Tip breakage occurred |
| Sample 12 | Tip breakage occurred |
| Sample 13 | No tip breakage |

As shown in Table 3, it was found that, in the case of the sample in which the maximum width of the recess measured on the cross section including the axis was greater than ⅓ of the width Dtw (sample 11), breakage of the tip occurred, and the tip was likely to come off upon application of vibration or the like thereto. Conceivably, breakage of the tip occurred because the thickness of the to-be-joined portion in the radial direction decreased, whereby the strength of the tip decreased.

It is also found that, in the case of the sample in which the bottom surface of the recess was located forward of the rear end of the part of the to-be-joined portion whose width on the cross section was 1.1 Dw or greater (sample 12), breakage of the tip occurred. Conceivably, breakage of the tip occurred because the strength of the part of the to-be-joined portion whose width on the cross section was 1.1 Dw or less (a part whose strength is likely to become insufficient) decreased as a result of formation of the recess over the entire region of that part.

In contrast, it is found that, in the case of the sample in which the maximum width of the recess measured on a cross section including the axis was ⅓ of the width Dtw or greater and the bottom surface of the recess was located rearward of the rear end of the part of the to-be-joined portion whose width on the cross section was 1.1 Dw or greater (sample 13), the tip did not break and had excellent impact resistance. Conceivably, breakage of the tip did no occur because the part of the to-be-joined portion around the recess had a sufficiently large wall thickness, and the recess was formed only partially in the part of the to-be-joined portion whose width on the cross section was 1.1 Dw or less, whereby a decrease in the strength of that part was suppressed sufficiently.

The results of the above-described test reveal that in order to enhance impact resistance and more reliably prevent coming off of the tip due to vibration or the like, it is preferred that the maximum width of the recess measured on a cross section including the axis be ⅓ of the width Dtw or greater and the bottom surface of the recess be located rearward of the rear end of a part of the to-be-joined portion whose width on the cross section is 1.1 Dw or greater.

The present invention is not limited to the above-described embodiment, but may be embodied, for example, as follows. Of course, applications and modifications other than those exemplified below are also possible.

(a) In the above-described embodiment, the center electrode 5 is formed of a single metallic element. However, the center electrode 5 may have a multi-layer structure which includes an inner layer formed of a metallic material which is excellent in thermal conductivity (e.g., copper, copper alloy, pure Ni, etc.) and an outer layer formed of a metallic material which contains Ni as a main component. In this case, the coefficient of linear thermal expansion of the center electrode 5 is the coefficient of linear thermal expansion of a portion of the center electrode 5 to which the tip 31 is joined.

Figure 14:
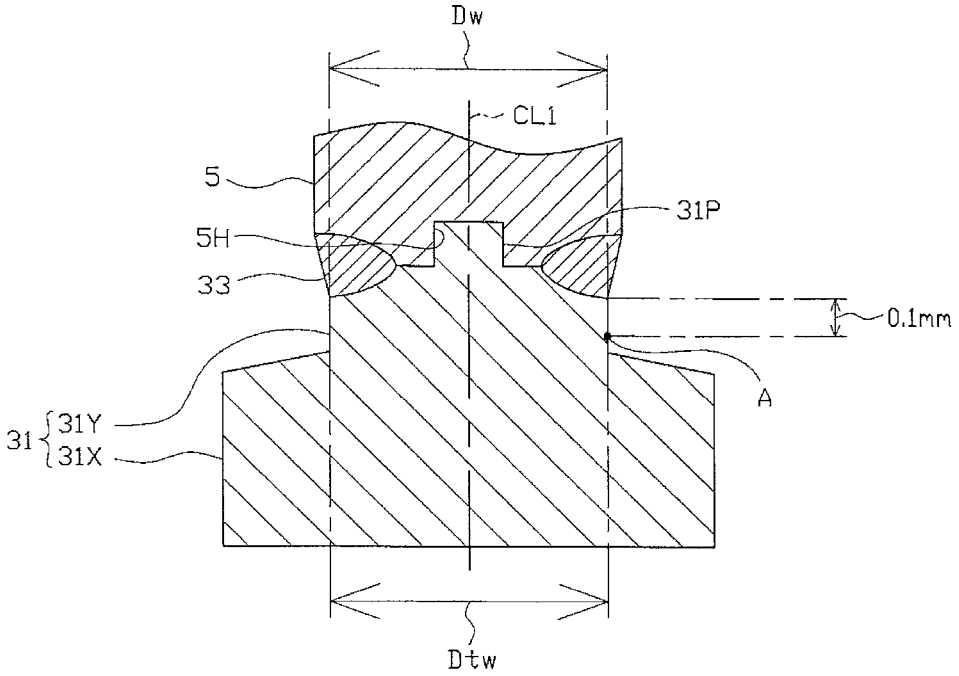
FIG. 14 is an enlarged partial sectional view showing the configurations of a center electrode and a tip in another embodiment.

(b) In the above-described embodiment, the protrusion 5P provided on the center electrode 5 is fitted into the recess 31H provided on the tip 31. However, as shown in FIG. 14, the embodiment may be modified such that a protrusion 31P provided on the tip 31 is fitted into a recess 5H provided on the center electrode 5

Figure 15:
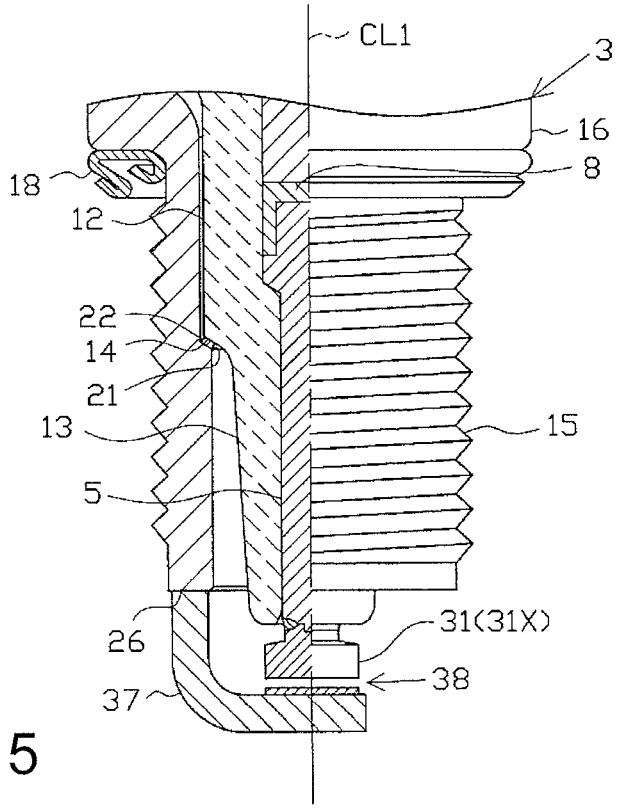
FIG. 15 is a partially cutaway enlarged front view showing the configuration of a ground electrode in another embodiment.
Figure 16:
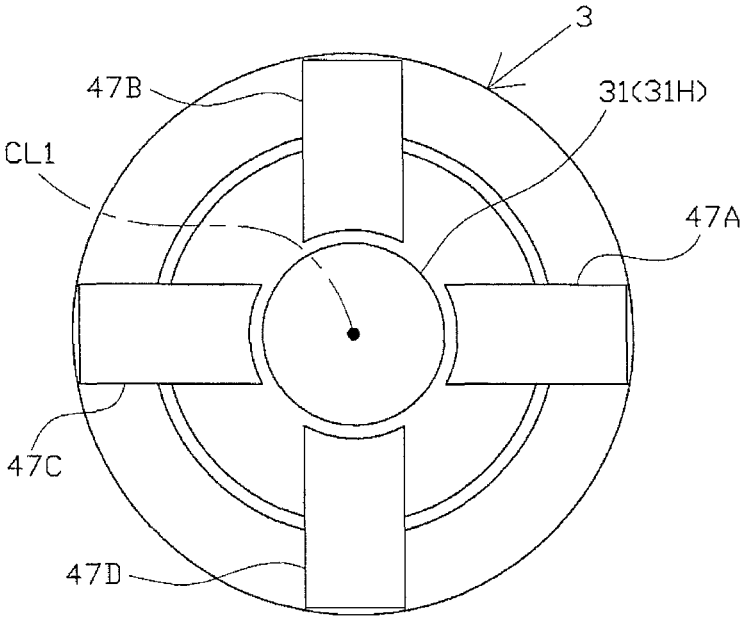
FIG. 16 is a bottom view showing the configuration of a ground electrode in another embodiment.

(c) In the above-described embodiment, the portion of the ground electrode 27 provided around the tip 31 has an annular shape. However, the shape of the ground electrode 27 is not limited thereto. For example, as shown in FIG. 15, a ground electrode 37 may have the shape of a rod which is bent at an intermediate portion thereof so as to form a spark discharge gap 38 between the side surface of the distal end portion of the ground electrode 37 and the forward end portion of the tip 31 (the gap-forming portion 31X). Alternatively, as shown in FIG. 16, a plurality of ground electrodes 47A, 47B, 47C, and 47D may be provided at equal intervals along the circumferential direction.

(d) In the above-described embodiment, the present invention is applied to the case where the ground electrode 27 is joined to the forward end portion 26 of the metallic shell 3. However, the present invention is also applicable to the case where a portion of a metallic shell (or a portion of an end metal welded beforehand to the metallic shell) is cut to form a ground electrode (refer to, for example, Japanese Patent Application Laid-Open (kokai) No. 2006-236906).

(e) In the above-described embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)]

(f) In the above-described embodiment, the tip 31 has a circular columnar shape. However, the shape of the tip 31 is not limited thereto. Accordingly, the tip may have the shape of a polygonal column (e.g., the shape of a square column).

DESCRIPTION OF REFERENCE NUMERALS

1: spark plug
2: ceramic insulator (insulator)
3: metallic shell
4: axial hole
5: center electrode
5P: protrusion
27: ground electrode
28: spark discharge gap (gap)
31: tip
31B: bottom surface (of recess)
31H: recess
31X: gap-forming portion
31Y: to-be-joined portion
33: fusion portion
CL1: axis

The invention claimed is:

1. A spark plug comprising:

a tubular insulator having an axial hole extending in a direction of an axis;

a center electrode inserted into a forward end portion of the axial hole;

a tubular metallic shell provided around the insulator;

a ground electrode provided at a forward end portion of the metallic shell; and a tip which is made of metal, whose base end portion is joined to a forward end portion of the center electrode and whose forward end portion forms a gap in cooperation with a distal end portion of the ground electrode, wherein the tip is joined to the center electrode through a fusion portion which is formed over the entire circumference of an interface between a peripheral portion of a rearmost end of the tip and an outer peripheral portion of a forward end of the center electrode and in which the tip and the center electrode are fused and mixed together, the center electrode has a coefficient of linear thermal expansion greater than that of the tip, the tip has a gap-forming portion which has a maximum width of 1.2 mm or greater as measured on a cross section including the axis and which forms the gap in cooperation with the ground electrode, and a to-be-joined portion which is located between the gap-forming portion and the fusion portion and adjacent to the fusion portion and which is joined to the center electrode, at a position A which is shifted 0.1 mm from a forward end of an outer surface of the fusion portion toward the forward end side with respect to the direction of the axis, the width of the to-be-joined portion, measured on the cross section including the axis, is made smaller than the width of the gap-forming portion measured on the cross section, and the to-be-joined portion satisfies a relation $Dtw/Dw \leq 1.1$, where Dtw represents the width (mm) of the to-be-joined portion at the position A measured on the cross section, and Dw represents the width (mm) of the fusion portion at the forward end of the outer surface thereof measured on the cross section.

2. The spark plug according to claim 1, wherein a relation $Dtw \leq Dw$ is satisfied.

3. The spark plug according to claim 1, wherein the tip is joined to the center electrode in a state in which a protrusion provided on one of the tip and the center electrode is fitted into a recess provided on the other of the tip and the center electrode.

4. The spark plug according to claim 3, wherein the recess is provided on the tip; and the maximum width of the recess measured on the cross section is ⅓ of the width Dtw or less.

5. The spark plug according to claim 3, wherein the recess is provided on the tip; and a bottom surface of the recess is located rearward of a rear end of a part of the to-be-joined portion whose width on the cross section is 1.1 Dw or greater.

6. The spark plug according to claim 1, wherein the tip is formed of iridium or a metal which contains iridium as a main component.

7. The spark plug according to claim 2, wherein the tip is joined to the center electrode in a state in which a protrusion provided on one of the tip and the center electrode is fitted into a recess provided on the other of the tip and the center electrode.

8. The spark plug according to claim 4, wherein the recess is provided on the tip; and a bottom surface of the recess is located rearward of a rear end of a part of the to-be-joined portion whose width on the cross section is 1.1 Dw or greater.

9. The spark plug according to claim 2, wherein the tip is formed of iridium or a metal which contains iridium as a main component.

10. The spark plug according to claim 3, wherein the tip is formed of iridium or a metal which contains iridium as a main component.

11. The spark plug according to claim 4, wherein the tip is formed of iridium or a metal which contains iridium as a main component.

12. The spark plug according to claim 5, wherein the tip is formed of iridium or a metal which contains iridium as a main component.

13. The spark plug according to claim 1, wherein the width of the gap-forming portion on the cross section is greater than that of the forward end portion of the center electrode.

14. The spark plug according to claim 1, wherein a rear end of the gap-forming portion does not make contact with the forward end of the center electrode.

* * * * *